US010580598B2

(12) United States Patent
Hayashi et al.

(10) Patent No.: US 10,580,598 B2
(45) Date of Patent: Mar. 3, 2020

(54) ELECTRICAL CONTACT SWITCH DEVICE

(71) Applicant: OMRON Corporation, Kyoto-shi, Kyoto (JP)

(72) Inventors: Hitoshi Hayashi, Kumamoto (JP); Koji Takami, Kyoto (JP); Kyoji Kitamura, Uji (JP); Tomoyuki Nishida, Takatsuki (JP); Toyohiro Imaizumi, Otsu (JP)

(73) Assignee: OMRON Corporation, Kyoto-shi (JP)

( * ) Notice: Subject to any disclaimer, the term of this patent is extended or adjusted under 35 U.S.C. 154(b) by 0 days.

(21) Appl. No.: 15/752,918

(22) PCT Filed: Jan. 11, 2017

(86) PCT No.: PCT/JP2017/000553
§ 371 (c)(1),
(2) Date: Feb. 15, 2018

(87) PCT Pub. No.: WO2017/159008
PCT Pub. Date: Sep. 21, 2017

(65) Prior Publication Data

US 2018/0374663 A1 Dec. 27, 2018

(30) Foreign Application Priority Data

Mar. 15, 2016 (JP) ..... 2016-051236

(51) Int. Cl.
*H01H 33/04* (2006.01)
*H01H 50/02* (2006.01)
(Continued)

(52) U.S. Cl.
CPC ..... *H01H 33/04* (2013.01); *H01H 33/42* (2013.01); *H01H 33/53* (2013.01); *H01H 50/02* (2013.01); *H01H 50/12* (2013.01); *H01H 50/54* (2013.01)

(58) Field of Classification Search
CPC ..... H01H 33/04; H01H 33/53; H01H 33/42; H01H 50/54
See application file for complete search history.

(56) References Cited

U.S. PATENT DOCUMENTS 5,204,647 A 4/1993 Nagamoto et al.
6,510,981 B1 * 1/2003 Deering ..... B65D 5/12 220/258.1
(Continued)

FOREIGN PATENT DOCUMENTS

CN 201397768 Y 2/2010
CN 202111006 U 1/2012
(Continued)

OTHER PUBLICATIONS

English translation of the International Search Report of PCT/2017/000553 dated Apr. 18, 2017.
(Continued)

*Primary Examiner* — Truc T Nguyen
(74) *Attorney, Agent, or Firm* — Metrolex IP Law Group, PLLC

(57) ABSTRACT

An electrical contact switch device includes: a fixed contact; a movable contact configured to come into contact with and move away from the fixed contact; a casing configured to house the movable contact and the fixed contact inside, and the casing includes at least one micro opening whose opening area is 80 $\mu m^2$ or less on an outer surface facing an outside.

14 Claims, 5 Drawing Sheets

(51) Int. Cl.

| | |
|---|---|
| ***H01H 50/12*** | (2006.01) |
| ***H01H 33/42*** | (2006.01) |
| ***H01H 33/53*** | (2006.01) |
| ***H01H 50/54*** | (2006.01) |

(56) References Cited

U.S. PATENT DOCUMENTS

| | | | | |
|---|---|---|---|---|
| 8,803,642 | B2 * | 8/2014 | Imamura | H01H 1/66 335/131 |
| 9,082,575 | B2 * | 7/2015 | Yamashita | H01H 9/443 |
| 2009/0134962 | A1 * | 5/2009 | Nishida | H01H 9/443 335/207 |
| 2017/0345593 | A1 * | 11/2017 | Nakai | H01H 33/08 |

FOREIGN PATENT DOCUMENTS

| | | | |
|---|---|---|---|
| CN | 104576210 | A | 4/2015 |
| JP | S58-5264 | U | 1/1983 |
| JP | 2005-203290 | A | 7/2005 |
| JP | 2007-73308 | A | 3/2007 |
| JP | 2007-73470 | A | 3/2007 |
| JP | 2009-76364 | A | 4/2009 |

OTHER PUBLICATIONS

English translation of the Written Opinion of PCT/JP2017/000553 dated Apr. 18, 2017.
Office action dated Sep. 26, 2018 in a counterpart Chinese patent application.

* cited by examiner (a)

(b)

(a)

(b)

ELECTRICAL CONTACT SWITCH DEVICE

TECHNICAL FIELD

The present invention relates to an electrical contact switch device which has a fixed contact and a movable contact.

BACKGROUND ART

In recent years, electrical contact switch devices each having a fixed contact and a movable contact for switching a large current and high voltage current have been widely used. In these electrical contact switch devices, an arc has occurred between the fixed contact and the movable contact due to the large current and the high voltage.

Therefore, attempts have been made to suppress the arc occurrence by various methods (see, for example, Patent Document 1).

PRIOR ART DOCUMENT

Patent Document

Patent Document 1: Japanese Unexamined Patent Publication No. 2007-73308

SUMMARY OF THE INVENTION

Problems to be Solved by the Invention

On the other hand, FIG. 4 is a graph illustrating a relationship between the number of switches and an oxygen concentration when an arc occurs at an electrical contact in the electrical contact switch device. As indicated by a case of sealing in FIG. 4, oxygen is consumed every time an arc occurs between the fixed contact and the movable contact. As the number of switches increases, the oxygen concentration in the casing which houses the fixed contact and the movable contact decreases. As a result, the oxygen concentration in the casing which houses the fixed contact and the movable contact is influenced by an internal space of the electrical contact switch device, yet goes below the oxygen concentration of 8% when the number of switches exceeds approximately 15,000 times.

FIG. 5(*a*) is a graph illustrating a relationship between an arc column width, and a contact gap and a time when an atmosphere is in the atmosphere, and the arc occurs at the electrical contact. FIG. 5(*b*) is a graph illustrating a relationship between the arc column width, and the contact gap and the time when an atmosphere is the oxygen concentration of 8%, and the arc occurs at the electrical contact. The inventors have found an occurrence of a phenomenon of a change in a behavior of an arc which widens a movement range in a vertical direction with respect to between the contacts of the arc represented by an arc column width approximately three times at a low oxygen concentration of approximately 8% as illustrated in FIG. 5 (*b*), compared with a case where the normal oxygen concentration is 21% (in the atmosphere) (FIG. 5 (*a*)). That is, as a result of intensive investigation, the inventors have observed on the relationship between the detailed behavior of the arc column and the number of switches, an oxygen state around the electrical contact becomes low and the amount of metal oxide on the surface of the electrical contact decreases, and therefore the probability of failure that the electrical contacts are welded increases. That is, the inventors have thought that, in environment with oxygen concentration less than 8%, a risk that an operational life of an electrical contact device is not satisfactory increases.

The electrical contact switch device needs to clear that the number of switches is approximately 100,000 times. That is, the electrical contact switch device which can secure an oxygen concentration of 8% or more in the casing when the number of switches becomes 100,000 times needs to be provided.

An object of the present invention is to provide an electrical contact switch device which can secure an oxygen concentration of 8% or more in the casing when the number of switches becomes 100,000 times.

Means for Solving the Problem

An electrical contact switch device according to the present invention includes: a fixed contact;

a movable contact configured to come into contact with and move away from the fixed contact;

a casing configured to house the movable contact and the fixed contact inside, and the casing includes at least one micro opening whose opening area is 80 $\mu m^2$ or less on an outer surface facing an outside.

Effect of the Invention

According to the electrical contact switch device according to the present invention, as illustrated in FIG. 1(*a*), at least one micro opening 24 whose opening area is 80 $\mu m^2$ or less is provided on the outer surface of the casing. Therefore, the oxygen concentration in the casing can be kept at 8% or more even after the number of switches becomes 100,000 times. Therefore, it is possible to suppress widening of a movement range of the arc between the fixed contact and the movable contact and welding between the electrical contacts.

MODE FOR CARRYING OUT THE INVENTION

Figure 1:
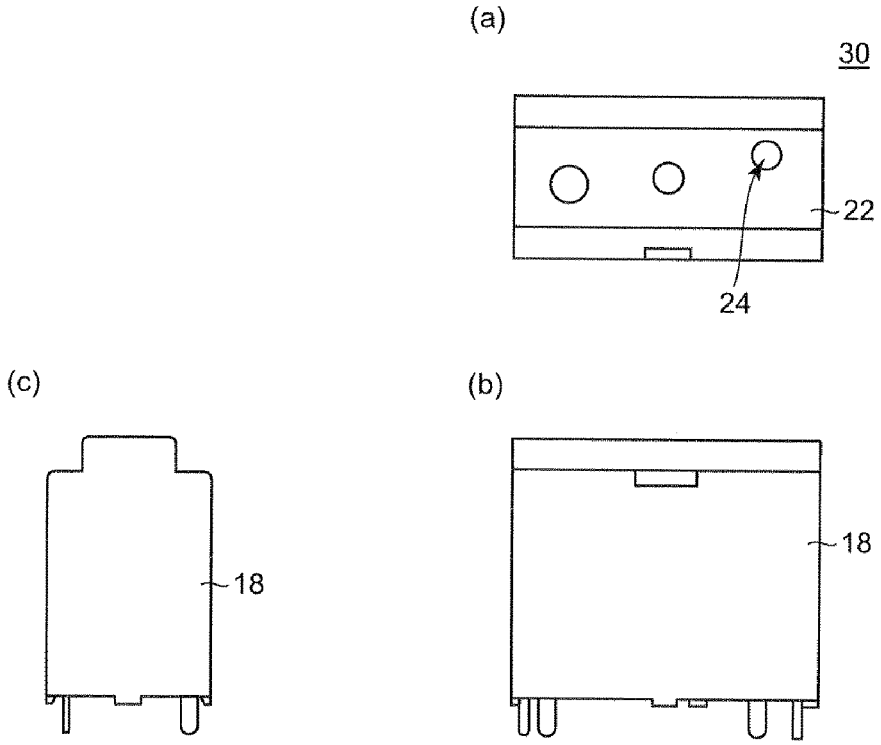
FIG. 1(*a*) is a plan view of an electrical contact switch device according to a first embodiment, FIG. 1(*b*) is a front view of FIG. 1(*a*), and FIG. 1(*c*) is a side view of FIG. 1(*a*).

An electrical contact switch device according to a first aspect includes: a fixed contact;

a movable contact configured to come into contact with and move away from the fixed contact;

a casing configured to house the movable contact and the fixed contact inside, and the casing includes at least one micro opening whose opening area is 80 $\mu m^2$ or less on an outer surface facing an outside.

According to the first aspect, in the electrical contact switch device according to a second aspect, the micro opening may have an opening diameter of 10 μm or less.

According to the first or second aspect, in the electrical contact switch device according to a third aspect, an inflow amount of oxygen of the micro opening into an internal atmosphere of the casing may be $1\times10^{-8}$ mol/hour or more.

According to one of the first to third aspects, in the electrical contact switch device according to a fourth aspect, the micro opening may have an opening diameter of 0.35 μm or more.

According to one of the first to fourth aspects, in the electrical contact switch device according to a fifth aspect, the micro opening may be provided on an outer surface other than a portion at which an intermediate surface between the fixed contact and the movable contact intersects with the casing contact among outer surfaces of the casing.

According to one of the first to fifth aspects, in the electrical contact switch device according to a sixth aspect, the micro opening may be provided on an outer surface other than a bottom surface among outer surfaces of the casing.

According to one of the first to sixth aspects, the electrical contact switch device according to a seventh aspect may further include an electromagnet configured to move the movable contact, and the electromagnet may be housed in the casing, and the micro opening may be provided on an outer surface at a portion at which the electromagnet is housed among outer surfaces of the casing.

According to one of the first to seventh aspects, in the electrical contact switch device according to an eighth aspect, a plurality of the micro openings may be provided.

According to one of the first to eighth aspects, in the electrical contact switch device according to a ninth aspect, a portion at which the micro opening is provided among outer surfaces of the casing may be made of a resin material.

According to one of the first to eighth aspects, in the electrical contact switch device according to a tenth aspect, a film or a sheet provided with the micro opening may be disposed in an opening of an outer surface facing the outside of the casing.

According to one of the first to tenth aspects, the electrical contact switch device according to an eleventh aspect may have water-resistance performance for preventing generation of bubbles for one minute or more in a water-resistant test in a case where an uppermost end of the casing is immersed at a depth of 10 mm or more in distilled water at a temperature range of 65° C. to 85° C.

Hereinafter, an electrical contact switch device according to an embodiment will be described with reference to the accompanying drawings. In the drawings, substantially the same members will be assigned the same reference numerals.

First Embodiment

Figure 2:
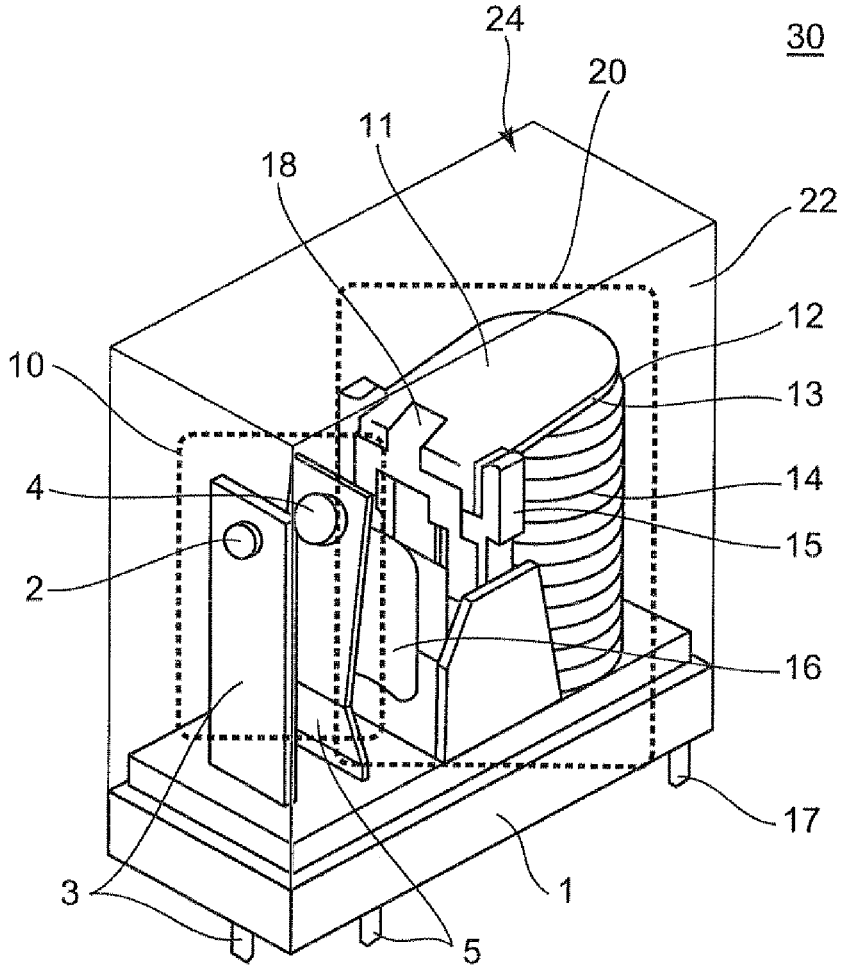
FIG. 2 is a schematic perspective view illustrating a configuration of the electrical contact switch device according to the first embodiment.

FIG. 1(*a*) is a plan view of an electrical contact switch device 30 according to the first embodiment, FIG. 1(*b*) is a front view of FIG. 1(*a*), and FIG. 1(*c*) is a side view of FIG. 1(*a*). FIG. 2 is a schematic perspective view illustrating a configuration of the electrical contact switch device 30 according to the first embodiment.

The electrical contact switch device 30 includes a fixed contact 2, a movable contact 4 which comes into contact with and moves away from the fixed contact 2, and a casing 22 which houses the movable contact 4 and the fixed contact 2. Further, the casing 22 includes at least one micro opening 24 whose opening area is 80 $\mu m^2$ or less on an outer surface. The micro opening 24 provided on the outer surface of the casing 22 can receive an inflow of oxygen from the outdoor air, and increase the oxygen concentration to 8% or more in the casing 22 even after the number of switches times becomes 100,000 times. The micro opening 24 has an opening diameter of 0.35 μm or more, so that it is possible to secure an oxygen inflow amount of $1\times10^{-8}$ mol/hour, and maintain the oxygen concentration at 8% or more in the casing 22 even after the number of switches times 100,000 times.

The switching frequency is a frequency that on is kept for one second, off is kept for nine seconds, and switching is performed once in ten seconds.

The electrical contact switch device 30 includes, for example, a base 1, an electrical contact 10 which is provided on the base 1, an electromagnet 20 which is provided on the base 1 and switches the electrical contact 10, and the casing 22 which houses the electrical contact 10 and the electromagnet 20. The electrical contact 10 includes a fixed piece terminal 3, the fixed contact 2 which is a distal end of the fixed piece terminal 3, a movable piece terminal 5, and the movable contact 4 which is a distal end of the movable piece terminal 5. The electromagnet 20 includes a spool 12, an iron core 13, a coil 14, a yoke 15, a card 16, a coil terminal 17, a movable iron piece 11, and a hinge spring 18. It is sufficient that the electrical contact switch device 30 includes at least the fixed contact 2, the movable contact 4, and the casing 22, and the other components may be appropriately changed.

Hereinafter, the components constituting the electrical contact switch device 30 will be described.

<Electrical Contact>

The electrical contact 10 includes the fixed piece terminal 3, the fixed contact 2 which is the distal end of the fixed piece terminal 3, the movable piece terminal 5, and the movable contact 4 which is the distal end of the movable piece terminal 5.

<Fixed Contact>

The fixed contact 2 is provided at the distal end (one end) of the fixed piece terminal 3. The fixed piece terminal 3 penetrates the base 1 and includes the other end protruding as a terminal from a back surface of the base 1.

<Movable Contact>

The movable contact 4 is provided at the distal end (one end) of the movable piece terminal 5. The movable piece terminal 5 penetrates the base 1 and includes the other end protruding as a terminal from the back surface of the base 1.

<Electromagnet>

The electromagnet 20 includes the spool 12, the iron core 13, the coil 14, the yoke 15, the card 16, the coil terminal 17, the movable iron piece 11, and the hinge spring 18.

Figure 3:
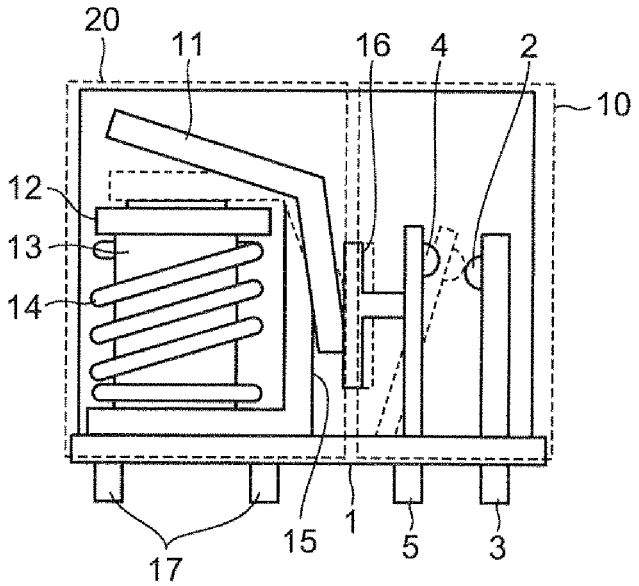
FIG. 3(*a*) is a schematic cross-sectional view illustrating an open state of an electrical contact, and FIG. 3(*b*) is a schematic cross-sectional view illustrating a closed state of the electrical contact.
Figure 3:
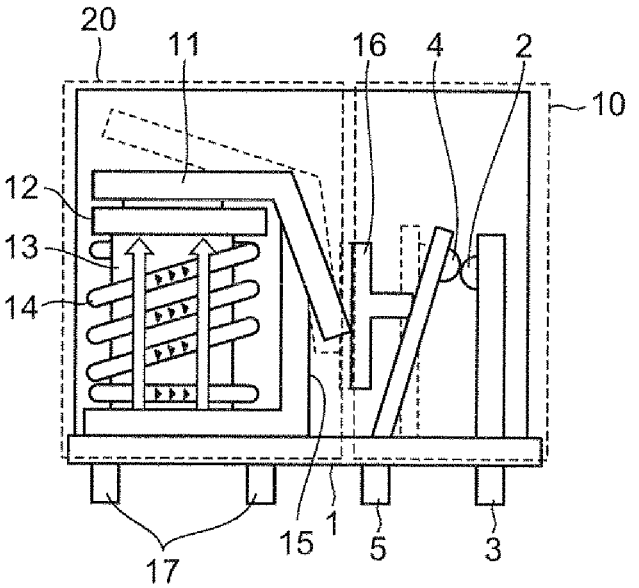

The coil 14 is connected to the coil terminal 17 protruding from the back surface of the base 1. The iron core 13 is wound around the coil 14. The iron core 13 includes one end (a lower end in FIG. 2) in contact with the yoke 15, and the other end (an upper end in FIG. 2) protruding the spool 12. The other end of the iron core 13 faces the movable iron piece 11 connected to the card 16 via the hinge spring 18. When the coil 14 is energized, the iron core 13 is excited and attracts the movable iron piece 11. When the movable iron piece 11 is attracted toward the iron core 13, the card 16 pushes the movable piece terminal 5 via the hinge spring 18, the movable contact 4 at the distal end of the movable piece terminal 5 contacts the fixed contact 2, and enters the energized state (closed state: FIG. 3(*b*)). When the energization to the coil 14 is cut off, the iron core 13 is demagnetized and stops attracting the movable iron piece 11, the card 16 returns to the original position, and the movable contact 4 at the distal end of the movable piece terminal 5 moves away from the fixed contact 2 and enters an open state (FIG. 3 (*a*)).

<Switching Operation of Electrical Contact Switching Device>

FIG. 3(*a*) is a schematic cross-sectional view illustrating an open state of the electrical contact 10, and FIG. 3(*b*) is a schematic cross-sectional view illustrating a closed state of the electrical contact 10.

<Open State>

When the coil 14 is not energized, the iron core 13 is not excited or demagnetized when excited and stops attracting the movable iron piece 11, and the card 16 returns to the original position. As a result, the movable piece terminal 5 is not pushed by the card, and the movable contact 4 at the distal end of the movable piece terminal 5 is apart from the fixed contact 2 and enters the open state (FIG. 3(*a*)).

<Closed State (Energized State)>

When the coil 14 is energized, the iron core 13 is excited and attracts the movable iron piece 11. When the movable iron piece 11 is attracted toward the iron core 13, the card 16 pushes the movable piece terminal 5 via the hinge spring 18, the movable contact 4 at the distal end of the movable piece terminal 5 contacts the fixed contact 2, and enters the energized state (closed state: FIG. 3(*b*)).

<Casing>

The casing 22 houses the fixed contact 2 and the movable contact 4 inside. The casing 22 defines an inner side for housing the fixed contact 2 and the movable contact 4, and an outer side. This casing 22 includes at least the one micro opening 24 whose opening area is 80 $\mu m^2$ or less on an outer surface facing the outside. When the opening area of the micro opening 24 is exactly 80 $\mu m^2$, the oxygen inflow amount through the micro opening 24 becomes approximately $5\times10^{-8}$ mol/hour, and the oxygen concentration can be maintained at 21% even after the number of switches becomes 100,000 times. Further, the micro opening 24 may have the opening diameter of 10 μm or less. In this case, the opening area of the micro opening 24 is approximately 78.5 $\mu m^2$.

When the micro opening 24 is larger than the opening diameter of approximately 10 μm, bubbles are concerned to be generated from the micro opening 24 when the casing 22 is placed in water. That is, from the viewpoint of water-resistance, the micro opening 24 preferably has the opening diameter of 10 μm or less.

As described later, by setting the opening diameter portion to 10 μm or less, a water-resistant test in a case where the uppermost end of the casing is immersed at a depth of 10 mm or more in distilled water having a temperature range of 65° C. to 85° C. illustrates water-resistant performance which does not generate bubbles for one minute or more.

Furthermore, the micro opening 24 may have the opening diameter of 0.35 μm or more. Consequently, it is possible to secure the oxygen inflow amount of $1\times10^{-8}$ mol/hour into the internal atmosphere of the casing 22 via the micro opening 24. As a result, when the volume in the casing 22 is approximately 8 ml, the oxygen concentration can be maintained at 8% or more in the casing 22 even after the number of switches becomes 100,000 times.

Figure 4:
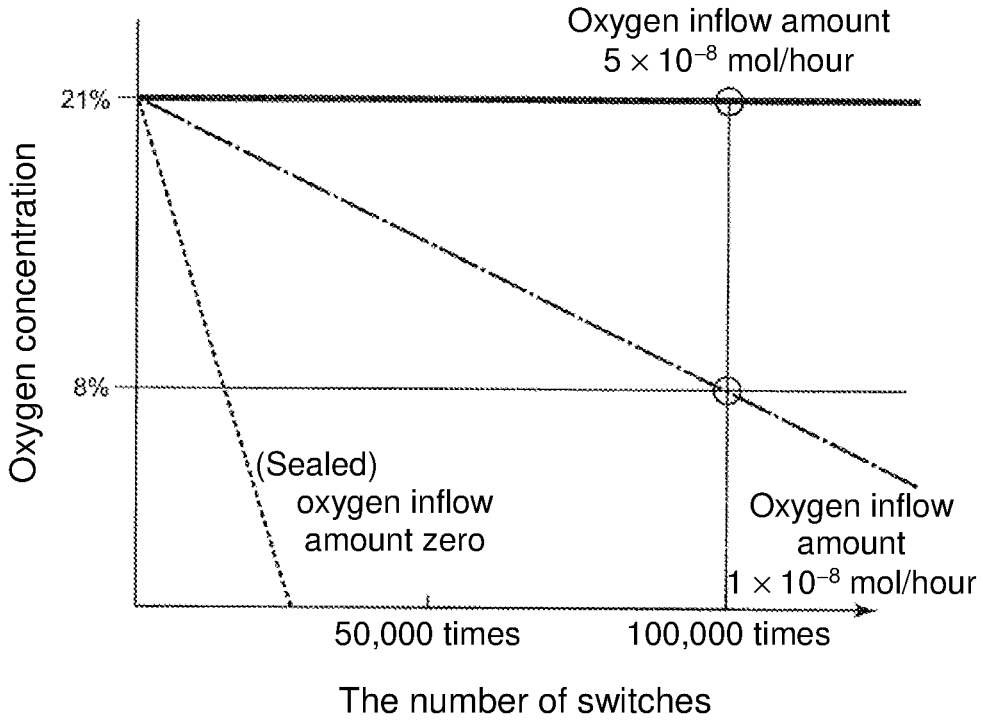
FIG. 4 is a graph illustrating a relationship between the number of switches and an oxygen concentration when an arc occurs at an electrical contact in the electrical contact switch device.
Figure 5:
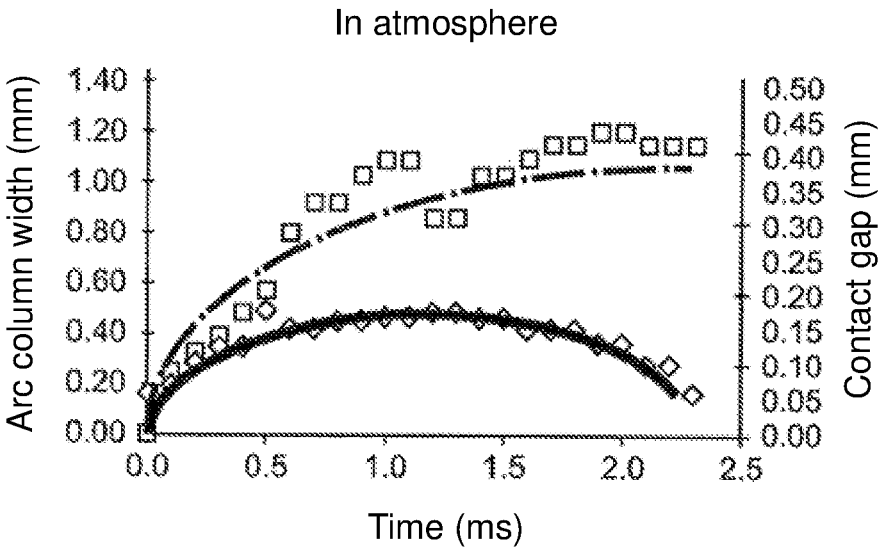
FIG. 5(*a*) is a graph illustrating a relationship between an arc column width, and a contact gap and a time when an atmosphere is in the atmosphere, and the arc occurs at the electrical contact, and FIG. 5(*b*) is a graph illustrating a relationship between the arc column width, and the contact gap and the time when an atmosphere has the oxygen concentration of 8%, and the arc occurs at the electrical contact.
Figure 5:
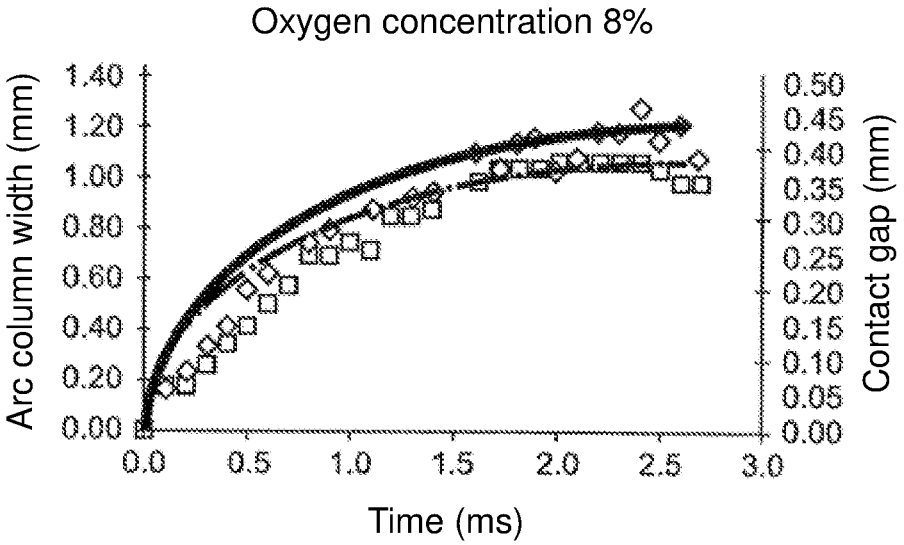

As illustrated in FIG. 4, in the sealed state in a case where the volume in the casing 22 is approximately 8 ml, the oxygen concentration decreases to 8% when the number of switches becomes approximately 15,000 times.

In the above example, the volume in the casing 22 is set to 8 ml, and the change in oxygen concentration is calculated. Here, the "volume inside the casing 22" refers to not the total volume including parts when the parts such as the spool are disposed in the casing 22, but the volume of gas in the casing 22 except the parts. As described above, the oxygen inflow amount is set to $5\times10^{-8}$ mol/hour by the micro opening 24 having the opening area of 80 $\mu m^2$. In this case, the oxygen concentration can be maintained at 21% even after the number of switches becomes 100,000 times. That is, in the above case, the oxygen consumption amount due to the arc occurrence and the oxygen inflow amount balance out. This is not related to the volume of the casing 22. On the other hand, when the oxygen inflow amount is less than $5\times10^{-8}$ mol/hour, the oxygen concentration decreases as the number of switches increases. In this case, an inclination of the decrease in the oxygen concentration with respect to the number of switches has a negative correlation with the volume of the casing 22. The inclination of the decrease becomes larger as the volume is smaller. When, for example, the volume of the casing 22 is 2 ml instead of 8 ml, it is necessary to set the oxygen inflow amount to approximately $4\times10^{-8}$ mol/hour in order to maintain the oxygen concentration at 8%. When the volume of the casing 22 is 4 ml, it is necessary to set the oxygen inflow amount to approximately $2\times10^{-8}$ mol/hour in order to maintain the oxygen concentration at 8%. Further, when the volume of the casing 22 is 12 ml, it is necessary to set the oxygen inflow amount to approximately $0.5\times10^{-8}$ mol/hour in order to maintain the oxygen concentration at 8%.

The micro opening 24 may be disposed on any of six surfaces of the casing 22 yet is desirably disposed on one of five surfaces except a bottom surface for ease of production, and is more desirably disposed on a top surface from the viewpoint of processing efficiency and convenience. In addition, the micro opening 24 may be provided on the outer surface other than the portion at which an intermediate surface between the fixed contact 2 and the movable contact 4 intersects with the casing 22 among the outer surfaces of the casing 22 facing the outside of the casing 22. That is, the intermediate surface between the fixed contact 2 and the movable contact 4 is the range that the scatters reach when the arc occurs. The opening area of the micro opening 24 is very small. Therefore, in order to suppress occurrence of clogging, it is preferable to avoid a range where the scatters spread when the arc occurs.

Further, the micro opening 24 may be provided on the outer surface of the portion at which the electromagnet 20 is housed among the outer surfaces of the casing 22. Thereby, it is possible to provide the micro opening 24 while avoiding the range in which the scatters spread when the arc occurs.

Note that a plurality of micro openings 24 may be provided.

Further, the shape of the micro opening 24 may be any shape such as a circular shape, an elliptical shape, a square shape, an oblong shape, a rectangular shape or a polygonal shape. Further, the micro opening 24 may have a slit shape. Furthermore, the cross-sectional shape of the micro opening 24 may spread toward the inside of the casing 22, for example, and may have may the narrowest cross-sectional area on the outer surface side. On the contrary, the cross-sectional shape may widen toward the outer surface side and have the narrowest cross-sectional area on the inside.

In the casing 22, a portion provided with the micro opening 24 among the outer surfaces of the casing 22 may be made of a resin material. A type of the resin material may be optional. In fields which require flame retardancy and heat resistance, the resin material may be made of an aromatic plastic such as fluorine resin, nylon resin, PBT, PC, LCP or PCT. Further, an opening may be provided on the outer surface of the casing 22, and a film provided with the micro opening 24 may be disposed in the opening.

<Water-Resistant Performance>

Further, in this water-resistant test in a case where the uppermost end of the casing is immersed at the depth of 10 mm or more in distilled water having a temperature range of 65° C. to 85° C., this casing 22 may have the water-resistant performance which does not generate air bubbles for one minute or more.

For example, the above water-resistant test was performed on the first and second examples in which the opening diameter was changed, and first to third comparative examples. In the above conditions, whether or not bubbles are generated is illustrated following in Table 1.

TABLE 1

| | Opening diameter (μm) | Whether or not bubbles are generated |
|---|---|---|
| Example 1 | 6 | No |
| Example 2 | 10 | No |
| Comparative Example 1 | 10.6 | Yes |
| Comparative Example 2 | 20 | Yes |
| Comparative Example 3 | 30 | Yes |

Table 1 illustrates that the water-resistant performance is satisfied when the opening diameter is 10 μm or less.

According to the electrical contact switch device 30 according to the present embodiment, at least the one micro opening 24 whose opening area is 80 $\mu m^2$ or less is provided on the outer surface of the casing 22. Therefore, the oxygen concentration can be maintained at 8% or more in the casing 22 even after the number of switches becomes 100,000 times. Therefore, it is possible to suppress widening of the movement range of the arc between the fixed contact and the movable contact and welding between the electrical contacts.

Incidentally, the present disclosure can include optional combinations of arbitrary embodiments and/or examples among the above-described various embodiments and/or examples, and provide the effect of each embodiment and/or each example.

INDUSTRIAL APPLICABILITY

According to the electrical contact switch device according to the present invention, at least one micro opening whose opening area is 80 $\mu m^2$ or less is provided on the outer surface of the casing. Consequently, it is possible to keep the oxygen concentration at 8% or more in the casing 22 even after the number of switches becomes 100,000 times, suppress widening of the movement range of the arc even when the arc occurs, and prevent welding between the electrical contacts.

DESCRIPTION OF SYMBOLS

1 base
2 fixed contact
3 fixed piece terminal
4 movable contact
5 movable piece terminal
10 electrical contact
11 iron piece
12 spool
13 iron core
14 coil
15 yoke
16 card
17 coil terminal
18 hinge spring
20 electromagnet
22 casing
24 micro opening
30 electrical contact switch device

The invention claimed is:

1. An electrical contact switch device comprising:
a fixed contact;
a movable contact configured to come into contact with and move away from the fixed contact; and
a casing configured to house the movable contact and the fixed contact inside,
wherein
the casing comprises at least one micro opening comprising an opening area of 80 $\mu m^2$ or less on an outer surface facing an outside, and
an inside of the casing comprises a volume of approximately 8 ml.

2. The electrical contact switch device according to claim 1, wherein the micro opening comprises an opening diameter of 10 μm or less.

3. The electrical contact switch device according to claim 1, wherein the micro opening comprises the opening area such that an inflow amount of oxygen via the micro opening into an internal atmosphere of the casing comprises $1\times10^{-8}$ mol/hour or more.

4. The electrical contact switch device according to claim 1, wherein the micro opening comprises an opening diameter of 0.35 μm or more.

5. The electrical contact switch device according to claim 1, wherein the micro opening is provided on the outer surface other than at a portion of the outer surface at which an intermediate surface between the fixed contact and the movable contact intersects with the casing among outer surfaces of the casing.

6. The electrical contact switch device according to claim 1, wherein the micro opening is provided on the outer surface other than a bottom surface among outer surfaces of the casing.

7. The electrical contact switch device according to claim 1, further comprising an electromagnet configured to move the movable contact, wherein
the electromagnet is housed in the casing, and
the micro opening is provided on the outer surface at a portion at which the electromagnet is housed among outer surfaces of the casing.

8. The electrical contact switch device according to claim 1, wherein the casing comprises a plurality of the micro openings.

9. The electrical contact switch device according to claim 1, wherein a portion at which the micro opening is provided among outer surfaces of the casing comprises a resin material.

10. The electrical contact switch device according to claim 1, wherein the electrical contact switch device comprises a water-resistant performance for preventing generation of bubbles for one minute or more in a water-resistant test comprising immersing an uppermost end of the casing at a depth of 10 mm or more in distilled water at a temperature range of 65° C. to 85° C.

11. The electrical contact switch device according to claim 2, wherein the micro opening comprises the opening area such that an inflow amount of oxygen via the micro opening into an internal atmosphere of the casing comprises $1\times10^{-8}$ mol/hour or more.

12. The electrical contact switch device according to claim 2, wherein the micro opening comprises an opening diameter of 0.35 μm or more.

13. The electrical contact switch device according to claim 3, wherein the micro opening comprises an opening diameter of 0.35 μm or more.

14. The electrical contact switch device according to claim 11, wherein the micro opening comprises an opening diameter of 0.35 μm or more.

* * * * *